US009518402B1

(12) United States Patent
Kundel, Sr. et al.

(10) Patent No.: US 9,518,402 B1
(45) Date of Patent: Dec. 13, 2016

(54) ANCHORING SYSTEM

(71) Applicant: Kundel Industries, Inc., Vienna, OH (US)

(72) Inventors: Robert Kundel, Sr., Cortland, OH (US); Robert Kundel, Jr., Cortland, OH (US); Richard A. Schley, Warren, OH (US)

(73) Assignee: Kundel Industries, Inc., Vienna, OH (US)

( * ) Notice: Subject to any disclaimer, the term of this patent is extended or adjusted under 35 U.S.C. 154(b) by 0 days.

(21) Appl. No.: 14/845,829

(22) Filed: Sep. 4, 2015

(51) Int. Cl.
*E04H 12/22* (2006.01)
*E04H 12/34* (2006.01)

(52) U.S. Cl.
CPC ..... *E04H 12/2261* (2013.01); *E04H 12/34* (2013.01)

(58) Field of Classification Search
CPC ..... E04H 12/223; E04H 12/2253; E04H 12/2261; E04H 12/2269; E04H 12/2276; E04H 12/2284; E04H 12/34; E04H 12/341; E02D 27/42; E02D 27/425; E02D 5/80
USPC ..... 52/223.1, 223.4, 223.13, 257, 40, 146,52/149, 150, 152, 170, 835, 651.07, 651.09,52/169.13, 296, 297
See application file for complete search history.

(56) References Cited

U.S. PATENT DOCUMENTS 1,430,136 A * 9/1922 Williams ..... E04H 12/2261 52/295
1,722,352 A * 7/1929 Rawley ..... E04H 12/2253 52/152
2,862,252 A * 12/1958 Beach, Jr. ..... E04H 12/34 29/429
3,371,458 A * 3/1968 Sturgill ..... E04H 12/10 182/178.5
4,000,624 A * 1/1977 Chow ..... E02B 17/025 405/204
4,295,308 A * 10/1981 Korfanta ..... E04H 12/2261 248/158
4,553,878 A * 11/1985 Willemse ..... E02B 17/02 405/203
4,557,629 A * 12/1985 Meek ..... E02B 17/0004 405/195.1
4,669,917 A * 6/1987 Sveen ..... E02B 17/027 405/204
4,687,380 A * 8/1987 Meek ..... E02B 17/027 405/203
4,860,507 A * 8/1989 Garza-Tamez ..... E02D 27/34 248/560
4,972,641 A * 11/1990 Barrios ..... E02D 5/38 249/48
5,002,252 A * 3/1991 Setala ..... A47G 33/12 248/523

(Continued)

*Primary Examiner* — James Ference
(74) *Attorney, Agent, or Firm* — Roth Blair Roberts Strasfeld & Lodge

(57) ABSTRACT

An anchoring system to secure a mounting plate at a base of a pole or column to a concrete foundation includes a plurality of base plates. Each base plate has a planar surface, center-point, and plurality of fastener openings spaced about the center-point. A plurality of concrete anchoring fasteners having a common cross-sectional diameter secures each base plate to the foundation. An attachment bolt at the center-point of each base plate extends perpendicular to the planar surface for securing through an attachment bolt opening inside a peripheral edge of the mounting plate. The anchoring fasteners for securing the base plates to the foundation are spaced apart no less than ten times the common cross-sectional diameter.

8 Claims, 10 Drawing Sheets

(56) References Cited

U.S. PATENT DOCUMENTS 5,051,037 A * 9/1991 Haney ..... E02B 17/027 405/203
5,063,719 A * 11/1991 Matsuo ..... E04H 12/2261 52/295
5,233,809 A * 8/1993 Gropper ..... E04H 12/187 343/882
5,465,529 A * 11/1995 Park ..... A47G 33/12 248/524
5,499,885 A * 3/1996 Chapman ..... E02D 27/42 403/297
5,570,546 A * 11/1996 Butterworth ..... E04H 12/34 343/890
5,572,846 A * 11/1996 Sosa ..... E04H 12/2292 256/1
6,014,843 A * 1/2000 Crumley ..... E04H 9/02 403/300
6,240,689 B1 * 6/2001 Haddad ..... E01F 9/681 248/49
6,343,445 B1 * 2/2002 Ryan ..... E04H 12/20 52/148
6,735,911 B1 * 5/2004 Alexander ..... E02D 5/80 248/500
6,857,808 B1 * 2/2005 Sugimoto ..... E04B 1/2403 248/903
7,156,586 B2 * 1/2007 Nim ..... B63B 35/44 405/195.1
7,252,083 B2 * 8/2007 Hayden ..... F24J 2/525 126/600
7,508,088 B2 * 3/2009 Kothnur ..... F03D 13/22 290/43
7,591,119 B2 * 9/2009 Ritz ..... E04H 12/2292 52/834
7,993,107 B2 * 8/2011 Gevers ..... F03D 1/001 248/163.1
8,161,698 B2 * 4/2012 Migliore ..... E02D 27/42 52/169.9
8,245,458 B2 * 8/2012 Johnson ..... E04H 12/347 52/146
8,269,690 B1 * 9/2012 Caruso ..... H01Q 1/1242 343/890
8,302,357 B1 * 11/2012 Nolte ..... E02D 31/002 52/220.2
8,302,365 B2 * 11/2012 Gee ..... E04H 12/34 52/117
8,319,697 B2 * 11/2012 Conrad ..... H01Q 1/08 343/840
8,347,514 B1 * 1/2013 McCollum ..... E04H 12/34 33/1 G
8,960,615 B1 * 2/2015 Johnson ..... F03D 1/001 248/163.1
2003/0021636 A1 * 1/2003 Silber ..... E02D 27/42 405/229
2003/0101634 A1 * 6/2003 Bhullar ..... A01M 1/226 43/1
2003/0196393 A1 * 10/2003 Bowman ..... E01F 9/681 52/295
2004/0131428 A1 * 7/2004 Henderson ..... E02D 27/42 405/233
2005/0081465 A1 * 4/2005 Crumley ..... E04H 9/14 52/223.1
2005/0183362 A1 * 8/2005 McCarthy ..... E04H 12/2253 52/295
2006/0022189 A1 * 2/2006 Collins ..... E04H 17/20 256/65.14
2007/0181767 A1 * 8/2007 Wobben ..... E02D 27/42 248/346.01
2008/0155907 A1 * 7/2008 Wobben ..... E02D 27/42 52/169.13
2008/0236073 A1 * 10/2008 Bagepalli ..... F03D 1/005 52/292
2008/0302038 A1 * 12/2008 Wobben ..... E02D 27/42 52/296
2009/0217607 A1 * 9/2009 Stark ..... E02D 27/42 52/298
2010/0257794 A1 * 10/2010 Stark ..... E04H 12/2215 52/158
2010/0301613 A1 * 12/2010 Oosterling ..... E02D 27/42 290/55
2011/0215206 A1 * 9/2011 Conrad ..... F16M 11/04 248/121
2012/0228442 A1 * 9/2012 Clifton ..... F24J 2/523 248/163.1
2012/0325761 A1 * 12/2012 Kubsch ..... F24J 2/4614 211/41.1
2013/0227897 A1 * 9/2013 Palmer ..... E02D 27/42 52/157
2013/0227898 A1 * 9/2013 Fairbairn ..... E02D 27/42 52/169.9
2013/0233231 A1 * 9/2013 Dagher ..... B63B 35/44 114/265
2013/0326992 A1 * 12/2013 Takagi ..... E04D 13/1407 52/649.2
2014/0069483 A1 * 3/2014 Wolter ..... H01L 31/0422 136/246
2014/0115978 A1 * 5/2014 Fairbairn ..... E02D 27/42 52/126.1
2015/0159337 A1 * 6/2015 Kellner ..... E04H 12/2215 248/156
2015/0191929 A1 * 7/2015 Takahashi ..... E02D 27/42 52/295

* cited by examiner

ANCHORING SYSTEM

FIELD OF THE INVENTION

This invention relates to an anchoring system for a pole or column to a hard surface such as a rock, concrete or like foundation, and wherein the system comprises a plurality of plates arranged about a base of the pole or column held by anchoring fasteners symmetrically aligned and disposed a predetermined distance for securing the same to the foundation.

BACKGROUND

This invention is in the field of an anchoring system for supporting an elongated member like a sign post, light pole or jib crane pillar in a solid foundation (such as a top and bottom supported jib crane and/or floor mounted pillar type that telescopes, or the like). Moreover, the invention in this case is directed to an anchoring system for providing a pole support as shown, for example, in U.S. Pat. No. 5,878,540.

The supported pole or column is often mounted at a base having a mounting plate which extends perpendicularly to the longitudinal axis of the support pole or column to provide peripheral openings for receiving bolts so that the pole itself can be bolted to the solid foundation. In most instances, the foundation is of concrete and the bolts extend upwardly from an upper face thereof, so that the holes in the pole's mounting plate receive the bolts set in the concrete. Setting nuts and washers are placed on each bolt to fix and secure the mounting plate to the concrete foundation.

In many cases, however, the support pole is added or newly installed after the concrete has been in place—sometimes years later. In those cases, to install the support pole, the concrete is often broken and removed to form a hole, and a new concrete platform is laid therein with bolts pre-set to extend upwardly. In those cases, L-shape bolts are often set in place before the new concrete is poured, and the concrete is poured around the bolts to permanently secure the same therein.

Particular disadvantages of such installation are the cost, time, and damage to the surrounding concrete caused during the removal operation. Moreover, the concrete has to be removed by impact, such as by a jack hammer, which can cause deterioration to the structural strength of the surrounding concrete that remains outside the perimeter of the hole, as well as equipment and fixtures in close proximity. Further, the removal is labor intensive and time consuming, in that old concrete has to be chipped out, bolts set in place, new concrete poured, and time allowed for the new concrete to dry and set before the pole and/or column can be mounted and weight applied.

As an alternative to removing and then pouring new concrete, a second anchoring system is used in the art to save time and money. Using this alternative system, the pole or column is bolted to an existing floor using anchor bolts directly secured through openings spaced about the mounting plate. Moreover, holes are drilled in the concrete using a hammer drill and a carbide tip masonry drill bit, the same diameter as the anchor bolt. The concrete anchor bolts are then hammered into the drilled holes in aligned relationship to openings in the mounting plate. Then, by turning a corresponding nut, each anchor bolt is torqued to secure the mounting plate to the concrete. Unfortunately, if the anchoring system is not designed properly, the concrete can easily fracture with the expansion of the anchor bolts torqued tightly in the concrete and/or the mounting plate can be easily ripped from the concrete as shown in FIG. 2, if enough over-turn force is applied (such as when lifting a heavy load with a jib crane).

SUMMARY OF THE INVENTION

Whenever designing and installing an anchoring system in an existing concrete floor, it is important to consider the concrete depth of the floor, anchor bolt pattern, depth and number of spaced anchor bolts, and area of the mounting base used to secure a mounting plate to the foundation. A large number of anchor bolts about the base of the mounting plate may be preferable. However, a large number of anchor bolts of the type typically used, can damage the integrity of the foundation. Also, if the spacing of the anchor bolts is too close, the holding strength of the existing floor can be weakened. Further yet, if the pull-out pattern is a continuous line or circle within the perimeter of the mounting base—e.g., one anchor bolt after the other like the plurality of perforations around the outside of a postage stamp used to enhance tearing—the structural integrity of the foundation can be compromised.

The instant invention solves these and other problems. Moreover, according to one embodiment, the anchoring system in this case secures a mounting plate of a pole or column to a concrete foundation using between three and seven base plates. Each base plate includes a planar surface having a symmetrical shape about a common center. A plurality of fastener openings is symmetrically arranged with each other. Further, each opening is spaced an equal distance from its respective plate center. A plurality of threaded fasteners having a common diameter is used and preferably epoxied in place to secure each base plate to the concrete foundation by passing through one of the plurality of fastener openings. An attachment bolt at the center of each base plate extends upward and perpendicular to its respective planar surface for securing to the mounting plate (which is attached perpendicular to a longitudinal axis of the pole or column). The plurality of base plates can easily be attached to the mounting plate in a symmetrical pattern by corresponding attachment bolts such that all threaded fasteners are spaced apart at least ten times (10×) their common diameter.

Notably, one of the many advantages of the instant invention is the ability to engineer the hold strength by arranging the proper anchoring/fastening pattern using anchor plates (also referred to herein as "pods"). More specifically, the pull-pattern formed by the threaded fasteners can be expanded across a wider area in the foundation (i.e., both inside and outside the perimeter of the mounting plate). As a result, the turn-over force is better dispersed and distributed, and more force is needed for a failure to occur by fracture of the foundation.

Another advantage of the instant invention is that the turn-over pivot point of the mounting base at the foundation no longer has to be at the immediate perimeter of the mounting plate as in the prior art. Instead, the pivot point is extending out (i.e., beyond the perimeter of the mounting plate), thereby creating a wider holding area. Also, the break-away pattern of the threaded fasteners can be weaved in-and-out such that the fracture boundary of the foundation is extended and uneven. Therefore, more of the foundation has to fracture for there to be a failure.

With this invention, a designer can select the appropriate number of anchor plates for the best design to optimize the over-turn moment, pivot point, and break-away pattern of the pole or column. Also, with the instant anchoring system, the optimum design can be engineered so that a preferred minimum spacing between threaded fasteners can be maintained for the best strength (e.g., in most designs the spaced-distances between threaded fasteners is preferably at least 10× the common diameter of the fasteners).

Also, in most cases no two installation sites are exactly identical. The concrete foundation is old, the depth is different, and/or the concrete may or may not have reinforcement bar for enhanced strength and integrity. In summary, therefore, the anchoring system in the instant invention provides engineering options to structurally optimize the holding strength for the many different sites in the field, without having to lay new foundation. By uniquely designing the arrangement of the plurality of anchor plates using the appropriate anchoring/fastening pattern about the base of a mounting plate, the turn-over force needed to break-away the pole or column can be better engineered. For example, the turn-over force can be maximized for a jib crane or minimized for those occasions that the pole or column must be engineered to break-away easily such as for a sign or light pole along a freeway (i.e., in the preferred embodiment discussed infra, such arrangements can be engineered having different pod patterns such that the threaded fasteners are or are not within the preferred 10× the common fastener diameter).

DESCRIPTION OF THE DRAWINGS

The drawings included herewith are for the purpose of illustration only and not as a definition of the limits of the instant invention, for which reference should be made to the claims appended hereto. Other features, objects and advantages of this invention will become clear from the following more detailed description made with reference to the drawings in which:

DESCRIPTION OF THE PREFERRED EMBODIMENT

Figure 2:
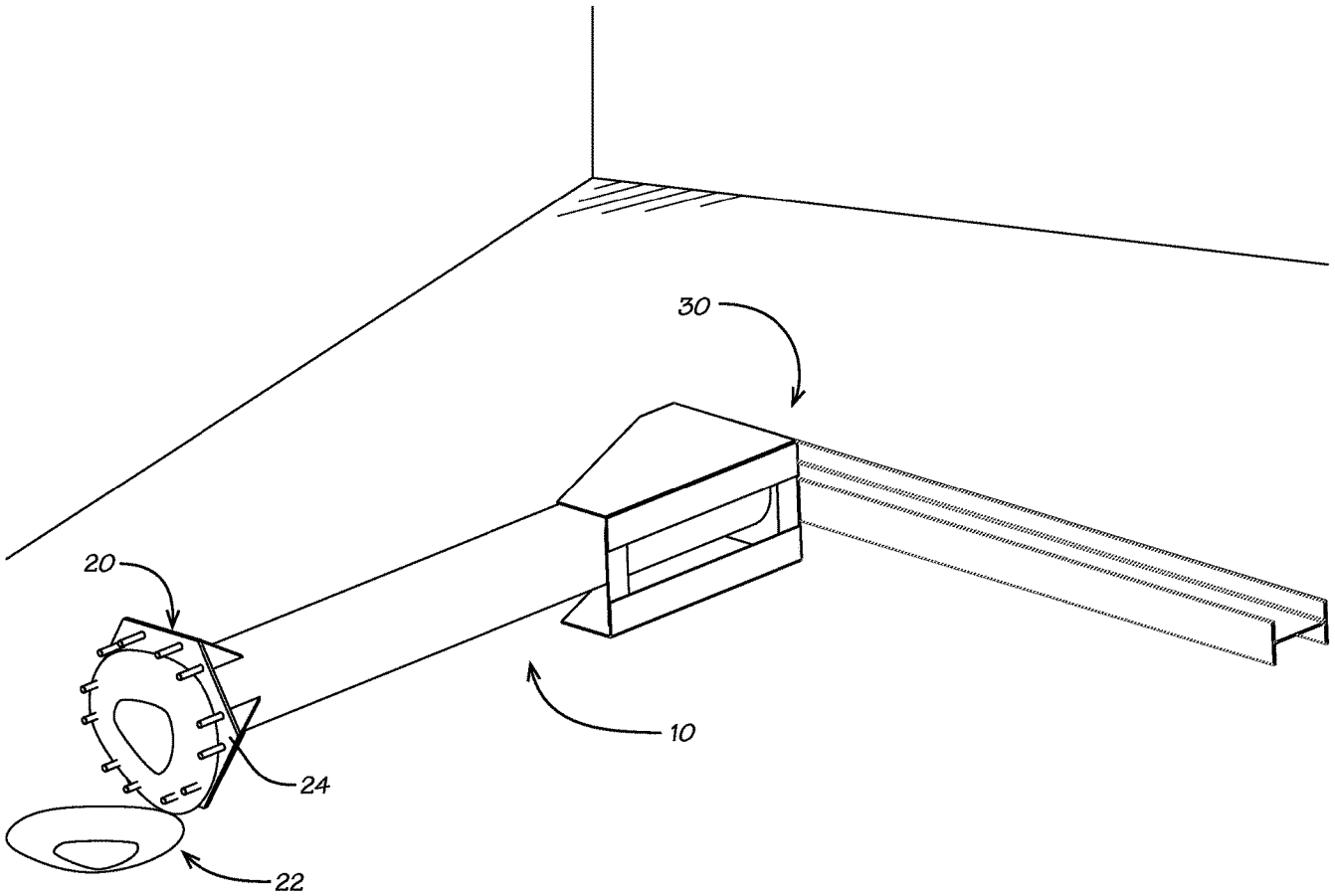
FIG. 2 illustrates a failed anchoring system in the prior art.

This description begins with reference to FIG. 2 and an explanation of the problem inherent therewith. The support systems used for poles or columns 10 in the prior art often include a mounting plate 24 extending perpendicular to the longitudinal axis of the pole or column 10. The mounting plate 24 provides peripheral openings 26 for receiving anchor bolts so that the pole 10 can be secured to the solid concrete foundation. If L-shaped bolts are not set in place when new concrete is poured, the alternative is to drill holes in an existing foundation 22 and attach the base thereto using concrete anchor bolts 120, such as concrete wedge-type anchor bolts known in the industry.

Moreover, holes are drilled in the concrete using a hammer drill and a carbide tip masonry drill bit, the same diameter as the anchor bolt 120. The concrete wedge anchor bolts 120 are then hammered into the drilled holes to ensure the desired depth after passing through mount openings 26 around the periphery of the mounting plate 24. Then, by turning a corresponding nut 122, the unit is "snugged up" in the hole before the nut 122 is torqued to the required torque value. Problems with this overall prior design are discussed supra, and, although wedge anchor bolts 120 can be used with the instant invention with success, the preferred fastening method is to use threaded fasteners epoxied in their corresponding holes in the concrete, so as to avoid stresses in the concrete created when the anchor bolt is "snugged up" (i.e., wedged) in the hole.

Further describing the instant invention, it improves the prior art by affording better engineering and design of the anchoring system at each installation. Moreover, the anchoring system in this case can be engineered based on conditions and factors unique to each installation. Moreover, with the preferred embodiment of the instant invention (beginning with reference to FIG. 1A), a pole 10 can be secured to a concrete foundation 22 using three base plates 110 (also interchangeably referred to herein as "pods"). More or less pods 110 can be used as shown in FIGS. 5A through 5D; however, between three and seven pods 110 are preferred.

Figure 1B:
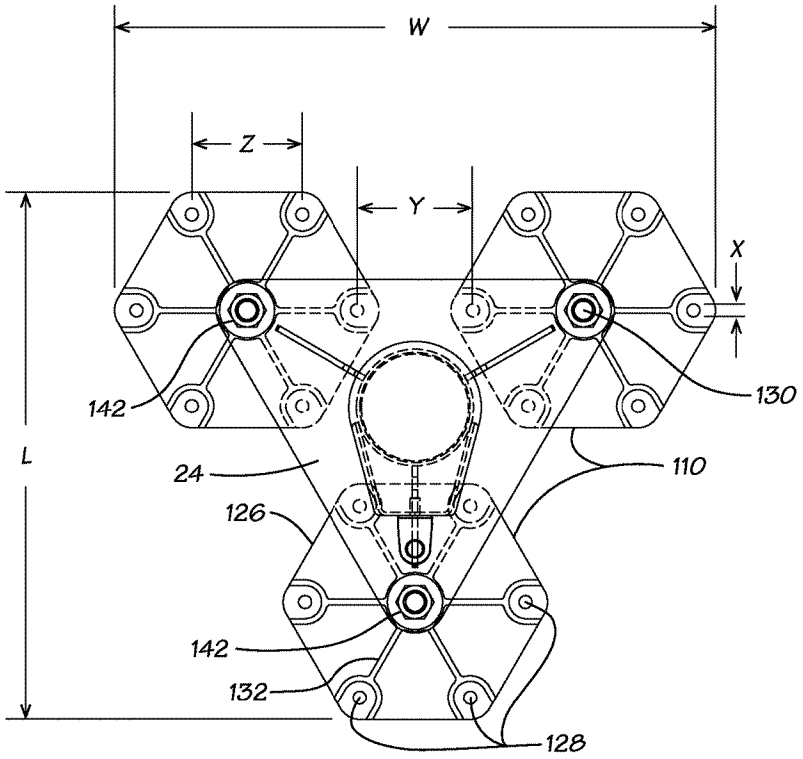
FIG. 1B is a plan view of the base plates of the anchoring system shown in FIG. 1A arranged in a symmetrical pattern to the mounting plate and foundation.
Figure 1A:
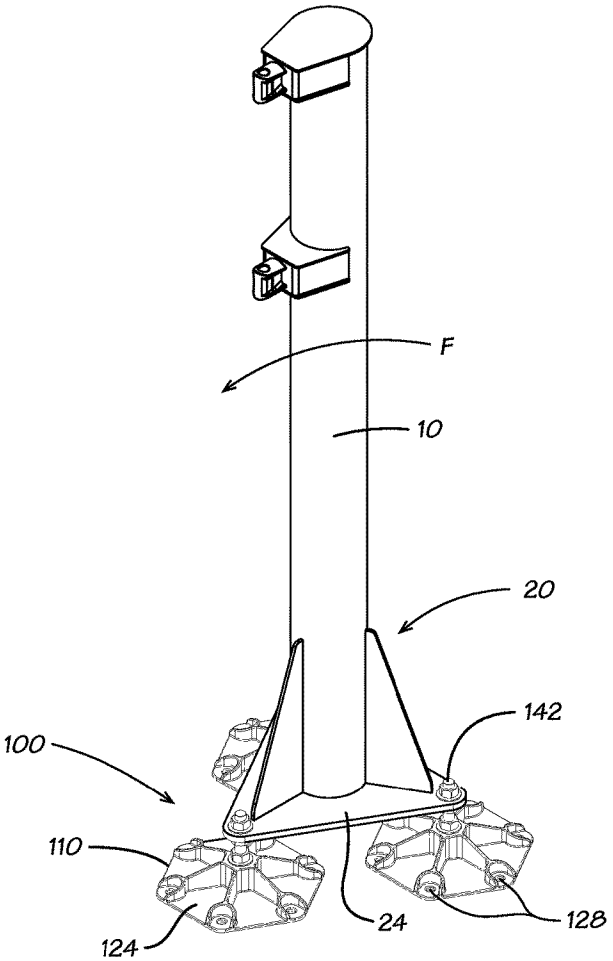
FIG. 1A is a perspective view of a pole secured to a concrete foundation using an embodiment of the instant invention with three base plates.
Figure 3A:
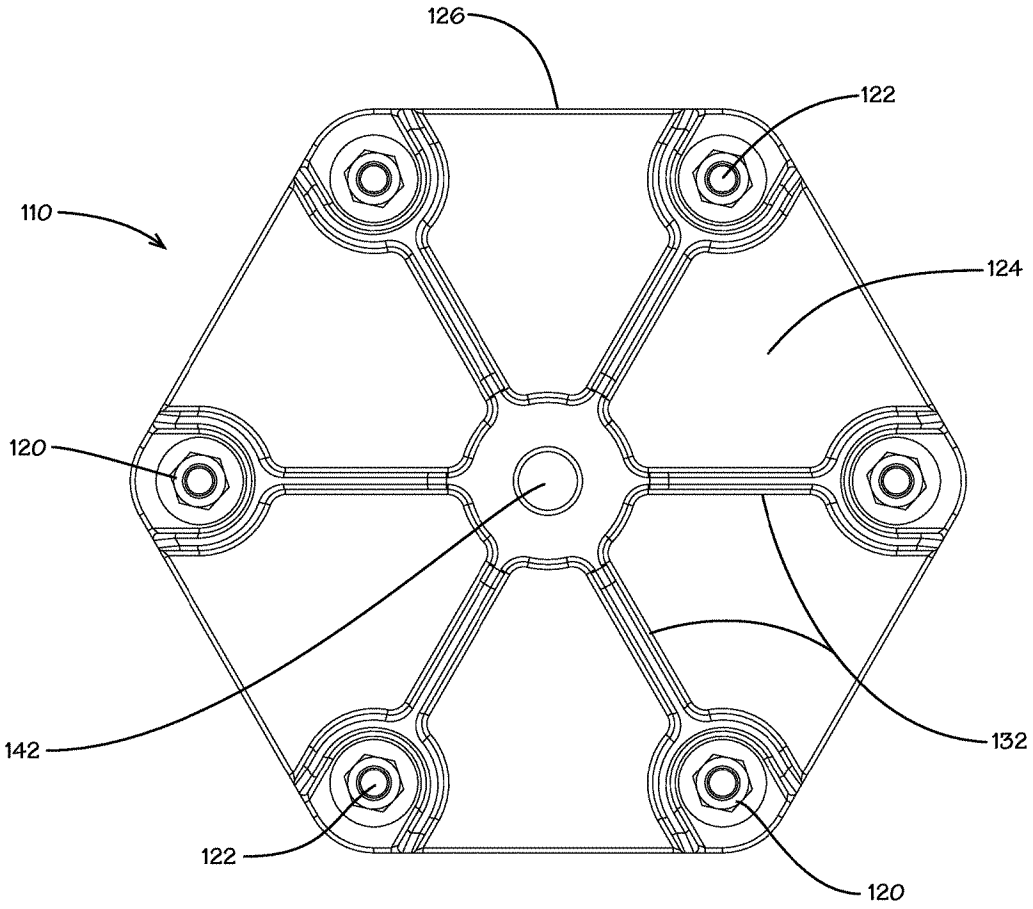
FIG. 3A is a top view and FIG. 3B is a side elevational view of the base plate shown in FIGS. 1A and 1B, illustrating a means of attachment to the concrete foundation using threaded fasteners epoxied in place.

Each pod or base plate 110 includes a planar surface 124 having a symmetrical shape about a common center point 130. A plurality of fastener openings 128 is symmetrically arranged about a perimeter of each base plate 110. Further, each opening 128 is spaced an equal distance from the respective center 130. In the preferred embodiment, the pod 110 is hexagonal in shape and the openings are evenly spaced in respective corners as best seen in FIG. 3A. Although not always essential and dependent on the thickness of the planar surface 124 of the base plate 110 and the over-turn force (F) designed to withstand, the preferred embodiment may include ribbing 132 in a hub-and-spoke configuration for added strength as best seen in FIGS. 1A and 1B.

A plurality of concrete anchor bolts 120 (such as common wedge-type concrete anchor bolts or, more preferably, threaded fasteners epoxied in place as described above) having a common diameter are used to secure each base plate 110 to the concrete foundation 22 by passing tightly through one of the plurality of fastener openings 128 and into the concrete. An attachment bolt 142 at the center of each base plate 110 extends perpendicularly upward to its respective planar surface 124 for securing the base plate 110 to the mounting plate 24 by bolt nuts 144. A plurality of base plates 110 can easily be attached to the mounting plate 24 in a symmetrical pattern by corresponding attachment bolts 142, such that all anchor bolts 120 are preferably arranged to be spaced no closer than at least ten times (i.e., 10X) the common diameter "x" of the anchor bolts 120, as best seen in FIGS. 1B and 5A-5D at "y", "z."

Figure 3B:
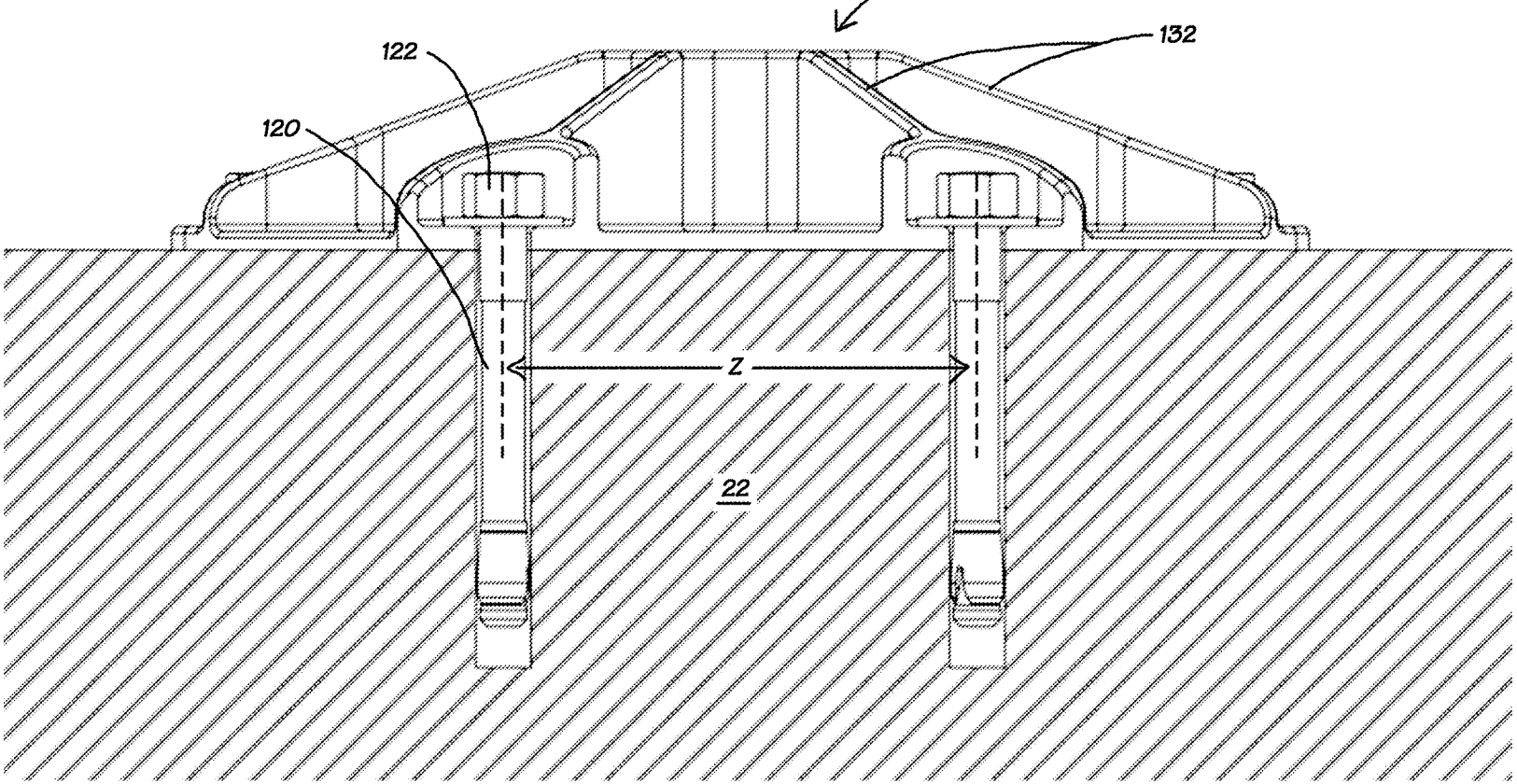

It is important to note the preferred engineering design of the instant invention. Each pod 110 has a central tension point at the attachment bolt 142. Further, since the anchor bolts 120 of each pod are preferably symmetrically aligned about the central tension point, the tension on the pod caused by an over-turn force (F) is evenly dispersed and distributed to its respective anchor bolts 120. Specifically, with reference to FIGS. 3A and 3B for instance, the tension is divided by six (6) (i.e., the number of anchor bolts). Further, with a properly engineered and preferably symmetrical pod arrangement about the mounting plate 24 (so that the closest distance between the anchor bolts is no less than 10× the anchor bolt diameter "x" whether there are three, four, five or more pods 110), the instant anchoring system 100 breaks up the otherwise continuous, circular perforated-pattern about the mounting plate 24 typical in prior art anchoring systems. Further, the instant anchoring system 100 provides a larger footprint (i.e., approximately ½ [L×W] of FIG. 1B) than the area of the mounting plate 24 (i.e. approximately ½ the square of the distance between attachment bolts 120 shown therein).

Moreover, unlike anchor systems in the prior art which create a continuous perforation that weakens the concrete for a crack fault and ultimate failure as shown in FIG. 2, by properly arranging the pods 110 of the instant invention about the base of the mounting plate 24 and securing the same using anchoring bolts 120 (such as threaded fasteners epoxied in the concrete, along with epoxying each pod 110 to the concrete surface) the hold strength can be maximized. Further, the instant invention can use more anchor bolts 120 than the prior art, without compromising the distance therebetween such that the foundation 22 is weakened. Using the spring-factor calculation method known in the art to analyze shared anchor tension, the proper design of an anchoring system 100 using the instant invention can be easily engineered to meet or surpass the required over-turn moment strength of the pole 10.

Figure 4B:
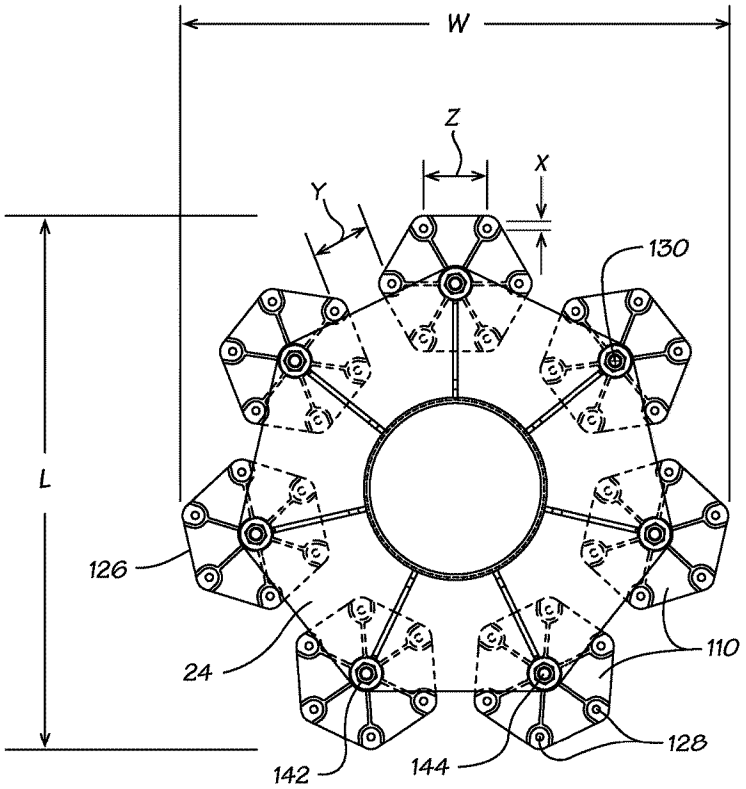
FIG. 4B is a plan view of the base plates of the anchoring system in FIG. 4A showing seven base plates arranged in a symmetrical pattern to the mounting plate and foundation.
Figure 4A:
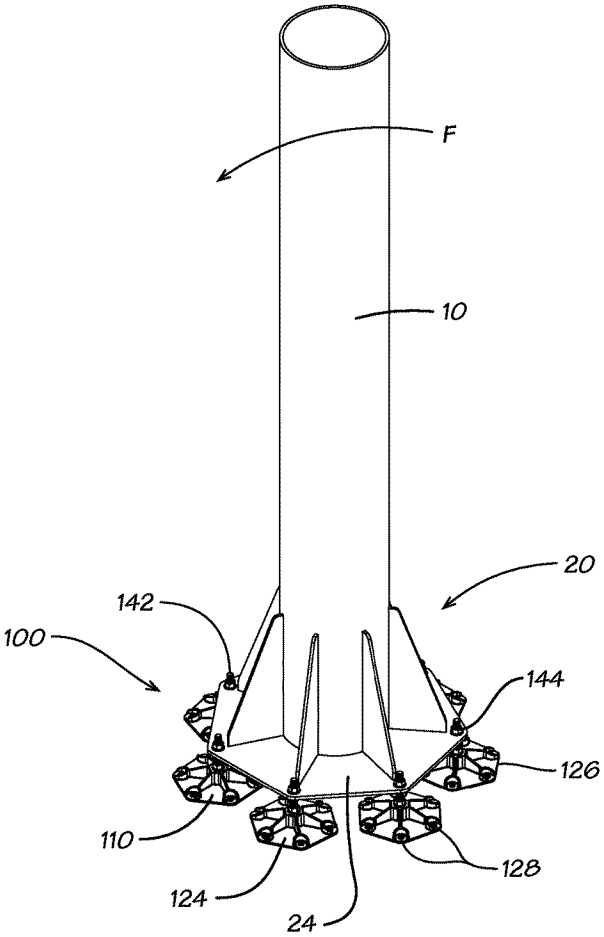
FIG. 4A is a perspective view of the pole secured to the concrete foundation as shown in FIG. 1A, using a second embodiment of the instant invention with simply seven planar base plates.
Figure 5A:
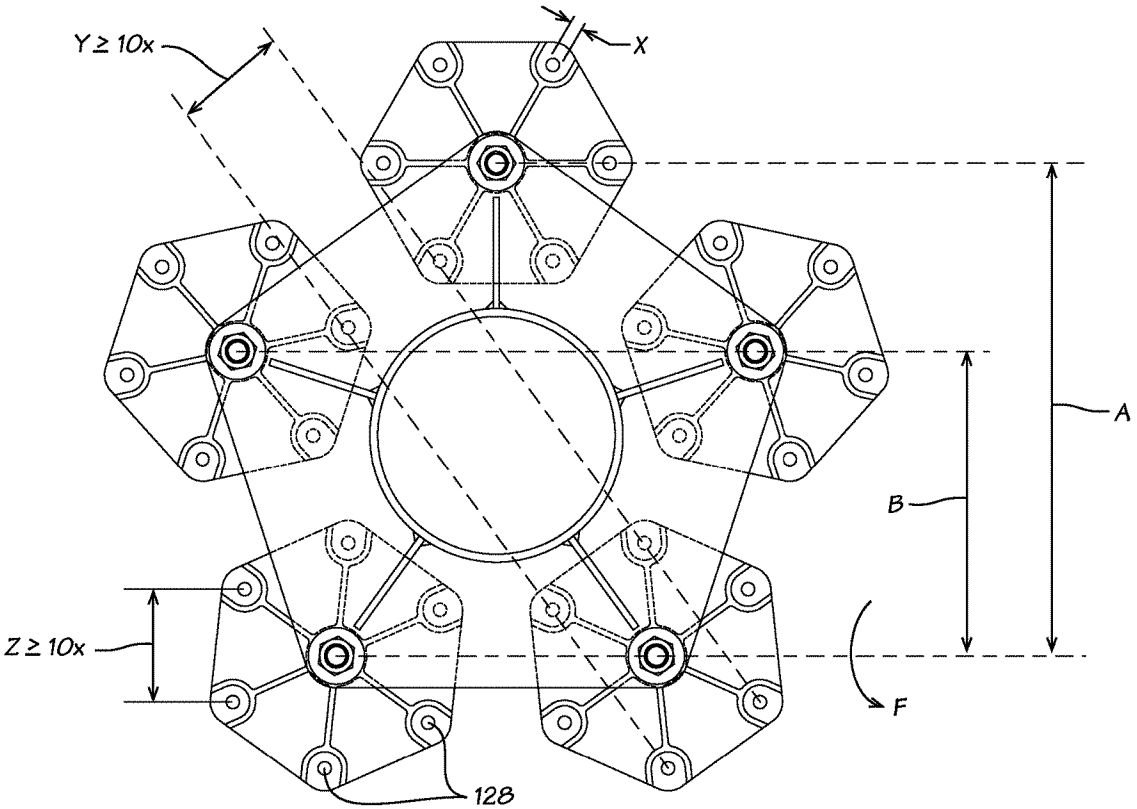
FIGS. 5A through 5D are plan views of different embodiments illustrating additional details and base plate patterns.
Figure 5B:
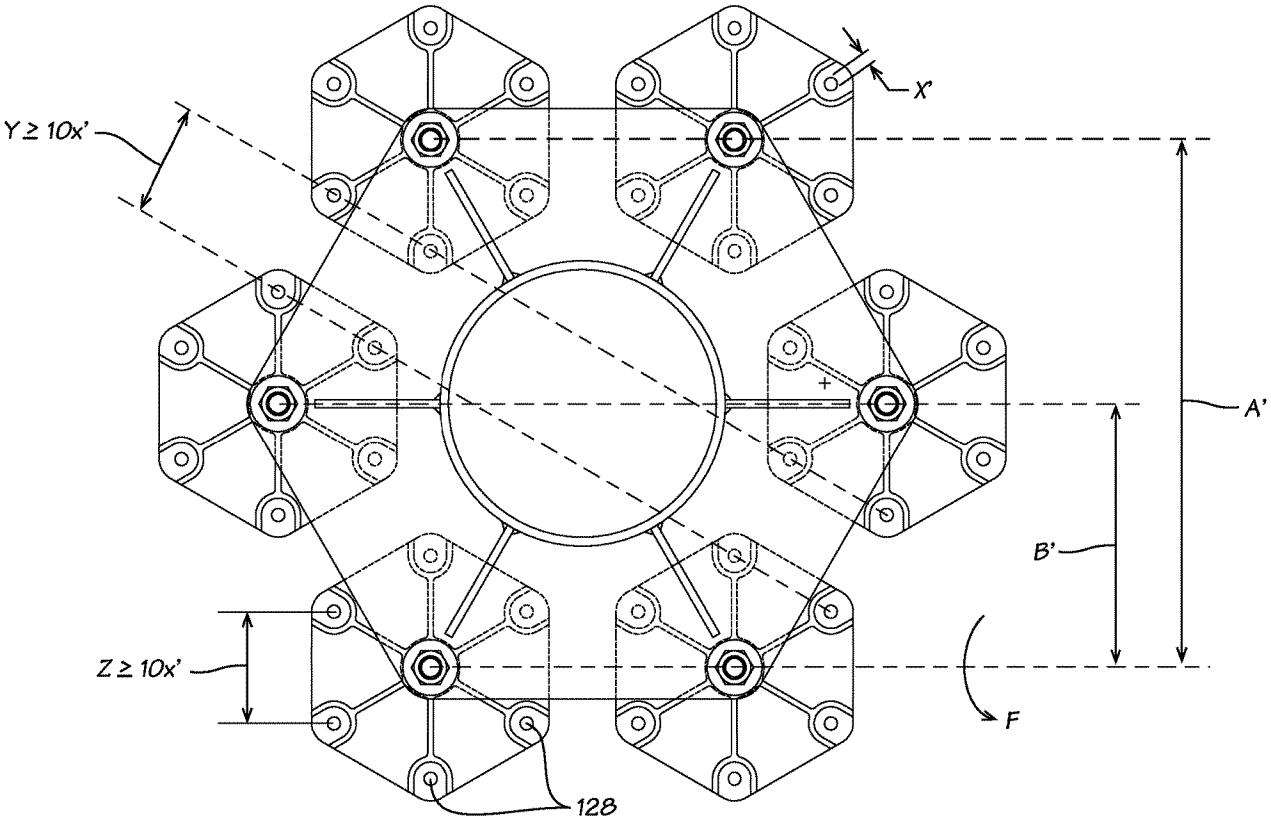
Figure 5C:
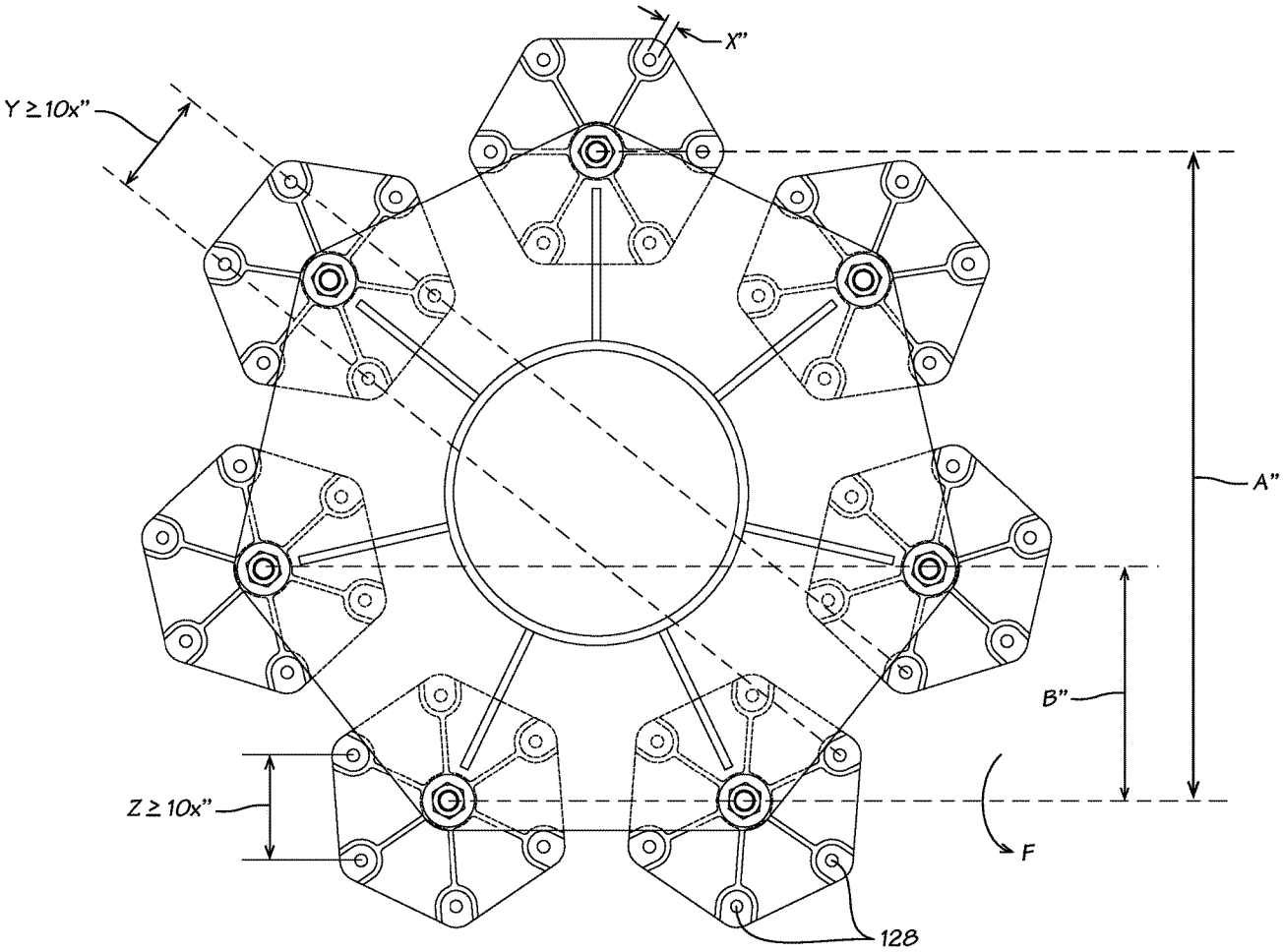
Figure 5D:
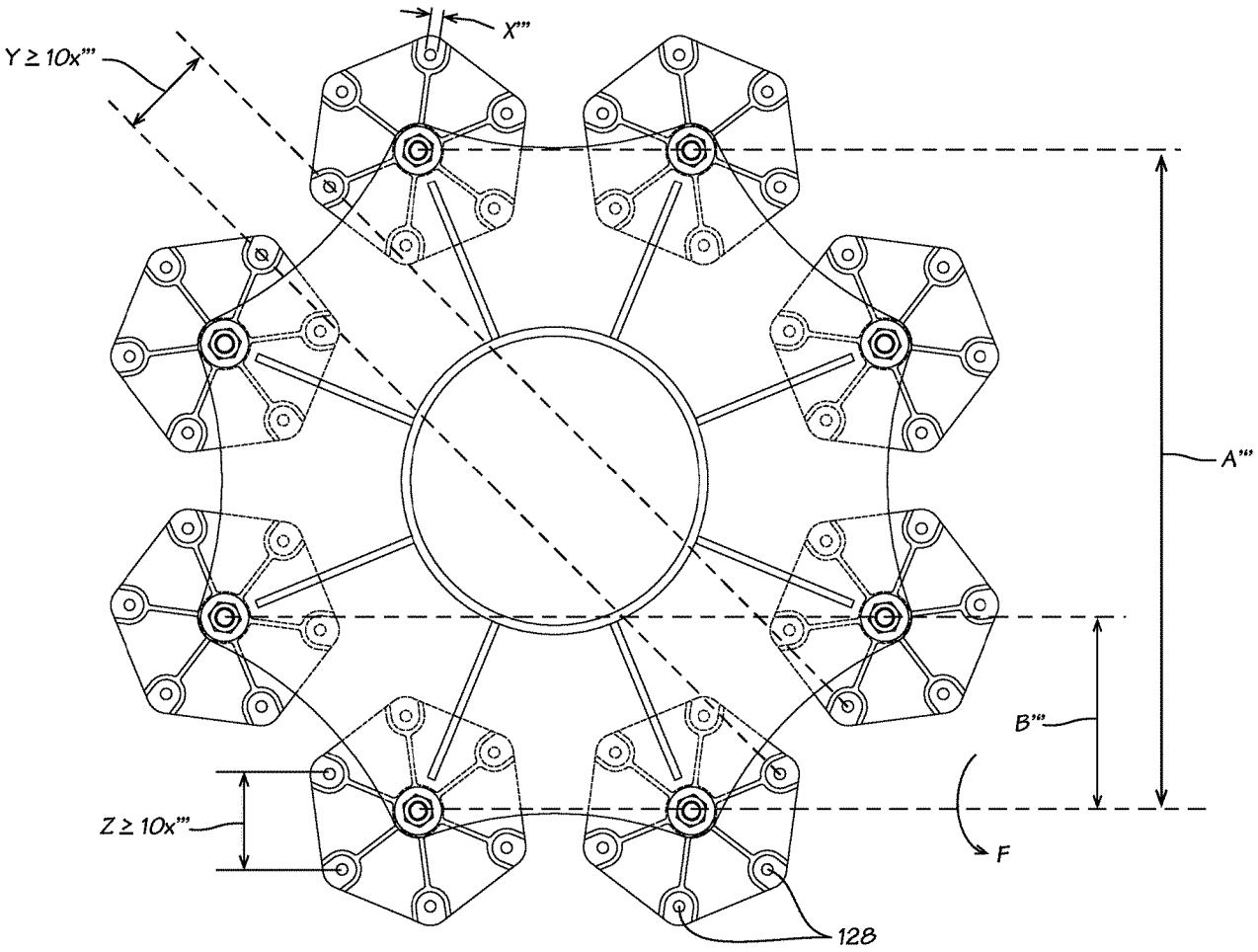
Figure 6:
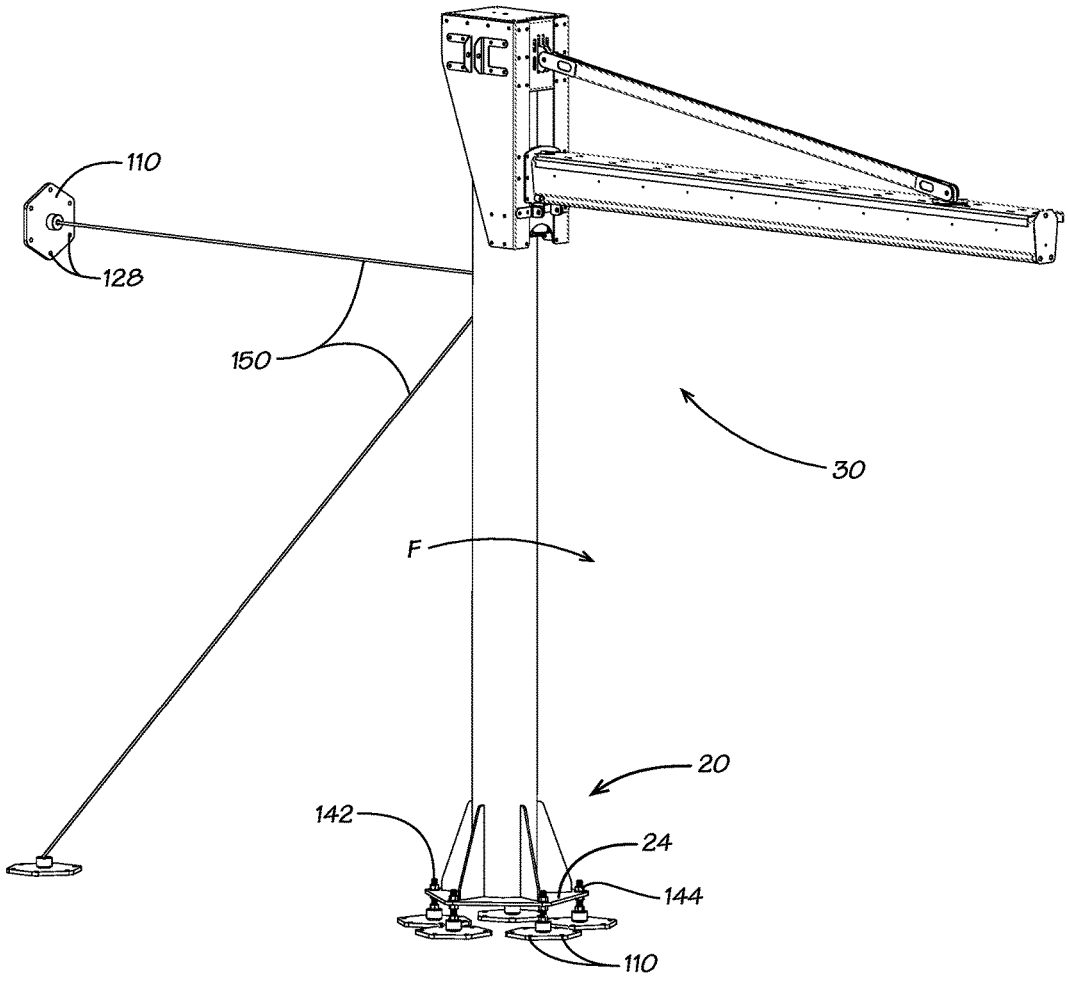
FIG. 6 is an illustration of yet another embodiment showing base plates with cabling as reinforcement in the anchoring system.

Finally, for added support FIG. 6 illustrates yet another embodiment using base plates with cabling 150 to reinforce the anchoring systems described in FIGS. 1A and 4A to oppose undue or repeated overturn forces F like, for example, repetitive overturn forces caused by repeated lifting by a jib-crane 30 from a common location. Further, using the instant invention, cabling 150 can be used to upgrade the strength of the jib-crane 30 and/or re-support a failing system caused by a weak, existing foundation.

It will thus be seen that variations of a new and useful anchoring system 100 with a plurality of base plates or pods 110 have been illustrated and described. With this description, it would be apparent to those skilled in the art that various combinations, changes or modifications may be made to the invention without departing from its spirit. For example, other variations of the anchoring systems 100 could include three-sided, four-sided, and/or five-sided pods, as well as circular pods, in place of the hexagonal pods illustrated in the Figures, or a combination of these different symmetrical shapes can be used, to form the most appropriate anchor for the conditions of the concrete foundation (i.e., having the appropriate strength and capacity to create the needed hold-down force for the desired over-turn rating).

In accordance with the provisions of the patent statutes, therefore, this invention has been explained and illustrated in the various preferred embodiments. It must be understood, however, that this invention may be practiced otherwise than as specifically illustrated without departing from the scope of the claims that follow.

What is claimed is:

1. An anchoring system for securing a mounting plate at a base of a pole or column to a rock or concrete foundation, the anchoring system comprising:

between three and seven base plates, each base plate having a planar surface and a symmetrical shape about a center-point with a plurality of fastener openings evenly spaced and symmetrically arranged, each opening spaced an equal distance from the center-point of each respective one of said base plates;

a plurality of concrete anchoring fasteners having a common cross-sectional diameter for securing each base plate to said foundation, each of the anchoring fasteners being passable through one of the plurality of fastener openings for securing into said foundation; and an attachment bolt at the center-point of each base plate extending perpendicular to the planar surface of each respective one of the base plates for securing to said mounting plate attached perpendicular to a longitudinal axis of said pole or column for anchoring to said foundation, the mounting plate having attachment bolt openings inside a peripheral edge of the mounting plate for receiving said attachment bolts, the plurality of base plates are arranged in a symmetrical pattern when each one of the base plates is secured to said mounting plate by a nut threaded to the attachment bolt of said respective base plate passing through one of the mounting plate openings wherein the attachment bolts provide adjustment of the longitudinal axis of said pole or column relative to said foundation, and further wherein the anchoring fasteners for securing the base plates to the foundation are spaced apart no less than ten times the common diameter of the anchoring fasteners.

2. The anchoring system of claim 1, wherein the anchoring fasteners are epoxied in the foundation.

3. The anchoring system of claim 2, wherein at least one of said base plates includes a face opposite said planar surface, said face having ribbing in a hub-and-spoke configuration for structural support with a hub portion of said ribbing about the center-point and a plurality of spoke portions radially extending from said hub portion, such that each respective one of said plurality of spoke portions extends to one of said plurality of fastener openings of said at least one base plate.

4. The anchoring system of claim 3, further comprising a remote base plate and a cable, wherein the remote base plate is not attached to the mounting plate and the cable extends from the remote base plate directly to the pole or column.

5. An anchoring system for securing a mounting plate at a base of a pole or column to a rock or concrete foundation, the anchoring system comprising:

at least three base plates, with each respective one of said base plates having a planar surface and at least six sides about a center in a symmetrical shape with a plurality of fastener openings evenly spaced and symmetrically aligned in plate corners, each one of the plurality of fastener openings spaced an equal distance from the plate center of the respective one of said base plates;

a plurality of threaded anchoring fasteners having a common length and cross-sectional diameter for securing each base plate to said foundation, with each of said anchoring fasteners being passable through one of the plurality of fastener openings for securement into the foundation; and an attachment bolt at the center of each one of the at least three base plates extending perpendicular to the corresponding planar surface of the said base plate for securing to said mounting plate attached perpendicular to a longitudinal axis of the pole or column for anchoring the pole or column to said foundation, each of the plurality of attachment bolts having a common diameter, and the mounting plate having attachment bolt openings inside a peripheral edge of the mounting plate for receiving said attachment bolts, so that each of the plurality of base plates are arranged in a symmetrical pattern when secured to said mounting plate by a nut threaded to the attachment bolt passing through one of said mounting plate openings wherein the attachment bolts provide vertical adjustability of the longitudinal axis of said pole or column relative to said foundation secured to the mounting plate and all anchoring fasteners are spaced apart a distance no less than ten times the common diameter of the anchoring fasteners.

6. The anchoring system of claim 5, wherein the anchoring fasteners and base plates are epoxied to the foundation.

7. The anchoring system of claim 6, wherein at least one of said base plates includes a face opposite said planar surface, said face having ribbing in a hub-and-spoke configuration for structural support with a hub portion about the center and a plurality of spokes radially extending from the hub to the plurality of fastener openings of said at least one base plate.

8. The anchoring system of claim 7, further comprising a remote base plate and a cable, wherein the remote base plate is not attached to the mounting plate and the cable extends from the remote base plate to the pole or column.

* * * * *